US005718505A

United States Patent [19]

Daumueller et al.

[11] Patent Number: 5,718,505

[45] Date of Patent: Feb. 17, 1998

[54] HEADLIGHT FOR VEHICLE

[75] Inventors: Hans Daumueller, Bodelshausen; Karl-Otto Dobler, Reutlingen; Rainer Neumann, Stuttgart, all of Germany; Frieder Liedtke, Penang, Malaysia; Johannes Bertling, Bangalore, India; Henning Hogrefe, Walddorfhaeslach, Germany; Gerd Bahnmueller, Holzgerlingen, Germany; Martin Lampen, Tuebingen, Germany

[73] Assignee: Robert Bosch GmbH, Stuttgart, Germany

[21] Appl. No.: 731,206

[22] Filed: Oct. 10, 1996

[30] Foreign Application Priority Data

Oct. 11, 1995 [DE] Germany ..... 195 37 838.5

[51] Int. Cl.[6] ..... F21V 13/10

[52] U.S. Cl. ..... 362/279; 362/61; 362/303; 362/305; 362/319

[58] Field of Search ..... 362/61, 80, 279, 362/290, 303, 305, 342, 343, 319

[56] References Cited

U.S. PATENT DOCUMENTS 5,077,649 12/1991 Jackel et al. ..... 362/325
5,264,993 11/1993 Neumann et al. ..... 362/61

FOREIGN PATENT DOCUMENTS 2590852 6/1987 France ..... 362/279
40 02 576A1 8/1991 Germany .

*Primary Examiner*—Stephen F. Husar
*Attorney, Agent, or Firm*—Michael J. Striker

[57] ABSTRACT

A headlight for vehicles has a light source, a reflector having at least two different reflector regions including a first reflector region which reflects a light emitted by the light source as a converging light beam to form low beam and a second reflector region formed so that light emitted by the light source and reflected by the second reflector region together with the light emitted by the light source and reflected by the first reflector region form high beam, a lens arranged after the reflector in a light outlet direction so that at least the light which forms low beam passes through the lens, and a screening device arranged between the reflector and the lens, the screening device having a stationary screening part and a movable screening part, the movable screening part being movable between a position for low beam in which light forming low beam can pass along the movable screening part and a position for high beam in which additionally the light reflected by the second reflector region can pass along the movable screening part at least partially, so that in the position for low beam an edge of the screening device forms a bright-dark limit of low beam, the screening parts each having a plurality of openings formed so that in the position of the movable screening part for low beam the movable screening part covers the openings of the stationary screening part, and in the position for high beam the openings of the movable screening part coincide with the openings of the stationary screening part at least approximately so that the screening device forms throughgoing openings for the light.

5 Claims, 2 Drawing Sheets

HEADLIGHT FOR VEHICLE

BACKGROUND OF THE INVENTION

The present invention relates to a headlight for vehicles.

More particularly, it relates to a headlight for vehicles provided with a light source and a reflector having at least two different reflector regions to form a low beam and a high beam correspondingly.

Headlights of the above mention general type are known in the art. One of such headlights is disclosed for example in the German patent document DE 40 04 576 A1. This headlight has a light source and a reflector provided with the above mentioned two reflector regions including an upper and a lower reflector region. The lower reflector region reflects the light emitted by the light source as a converging light beam to form a low beam, while the light reflected by the upper and lower reflector regions together forms a high beam. A lens is arranged after the reflector as considered in a light outlet direction, so that at least the light which forms the low beam and is reflected from the upper reflector region passes through the lens. A screening device is arranged between the reflector and the lens and has a single movable screen. It can move between a position for the low beam in which only the light forming the low beam and the reflected from the upper reflector region passes over it, and a position for high beam in which the light reflected from the upper and lower reflector regions passes on it. The screen has an edge which produces a bright-dark limit of the low beam in the position for low beam. The screen is turnable about an axis as a whole, which is however disadvantages since it requires a long displacement path. Moreover, a very accurate positioning of the screen in its position for low beam is needed to obtain an exact position of the bright-dark limit. This difficult because of the movability of the screen and requires an expensive guidance for the screen.

SUMMARY OF THE INVENTION

Accordingly, it is an object of present invention to provide a headlight for vehicles, which avoids the disadvantages of the prior art.

In keeping with these objects and with others which will become apparent hereinafter, one feature of present invention resides, briefly stated, in a headlight for vehicles, in which the screening devices is provided with a stationary screening part and a movable screening part both having several openings, the movable screening part in its position for low beam is arranged so that it covers the opening of the stationary screening part, and in its position for low beam is arranged so that its openings coincide with the openings of the stationary screening part at least approximately to be in alignment with them, so that the screening device forms through going openings.

When the headlight is designed in accordance with the present invention, it has the advantage that for adjusting the movable screening part between its positions for low beam and high beam, only a short displacement path is needed, and the bright-dark limit is obtained by the stationary screening part, so that inaccuracies during the adjusting movement of the movable screening part do not influence the position of the bright-dark limit.

In accordance with another feature of the present invention, the openings are formed as substantially horizontal slots which are separated from one another by light-impermeable webs, and the web of the movable screening part has a substantially greater width than the slot of the stationary screening part. In such a construction the screening device in the position for low beam is light-impermeable even in the case of inaccurate movement of the movable screening part.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
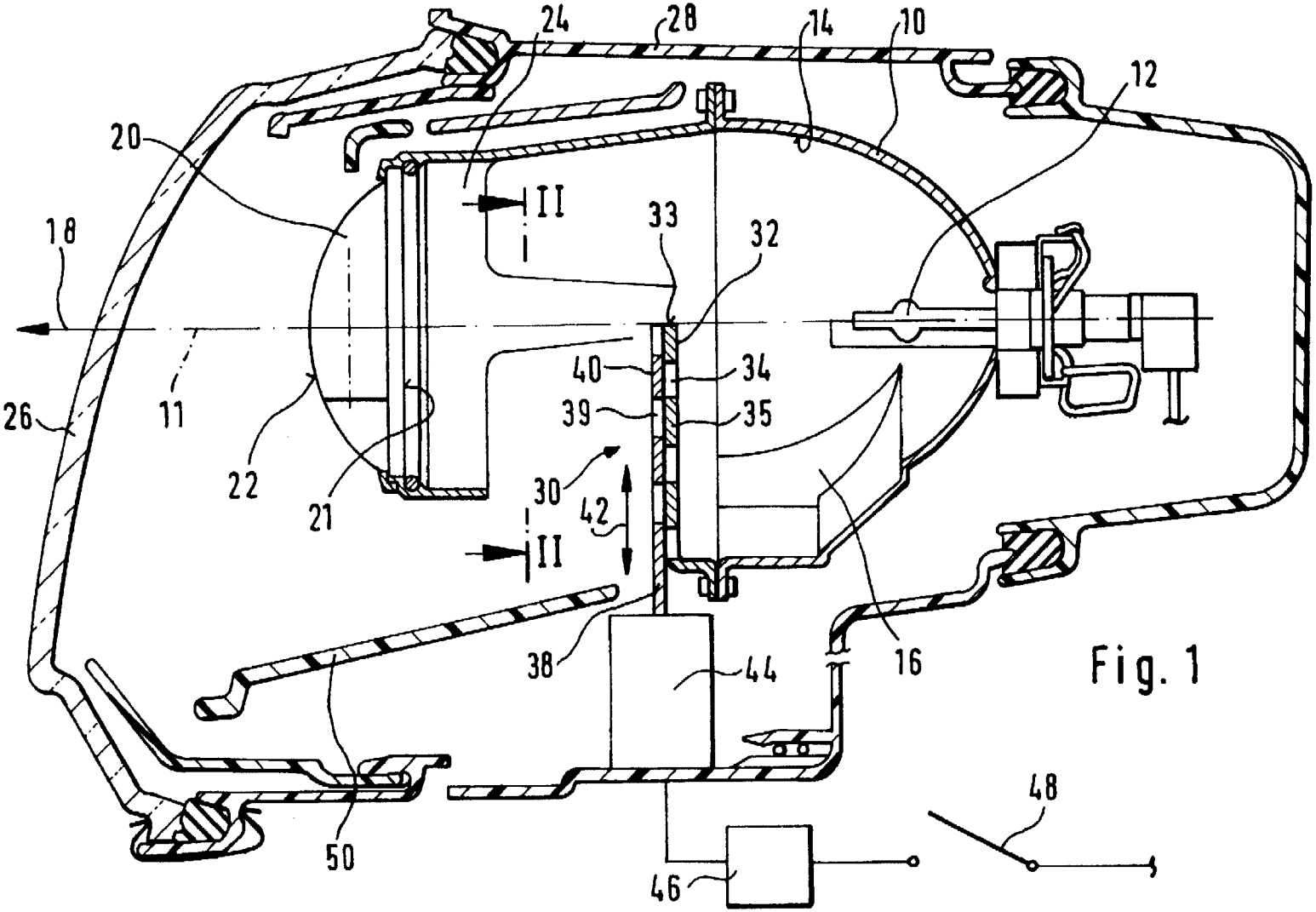
FIG. 1 is a view showing a headlight in accordance with a first embodiment of the present invention, in a vertical longitudinal section.
Figure 2:
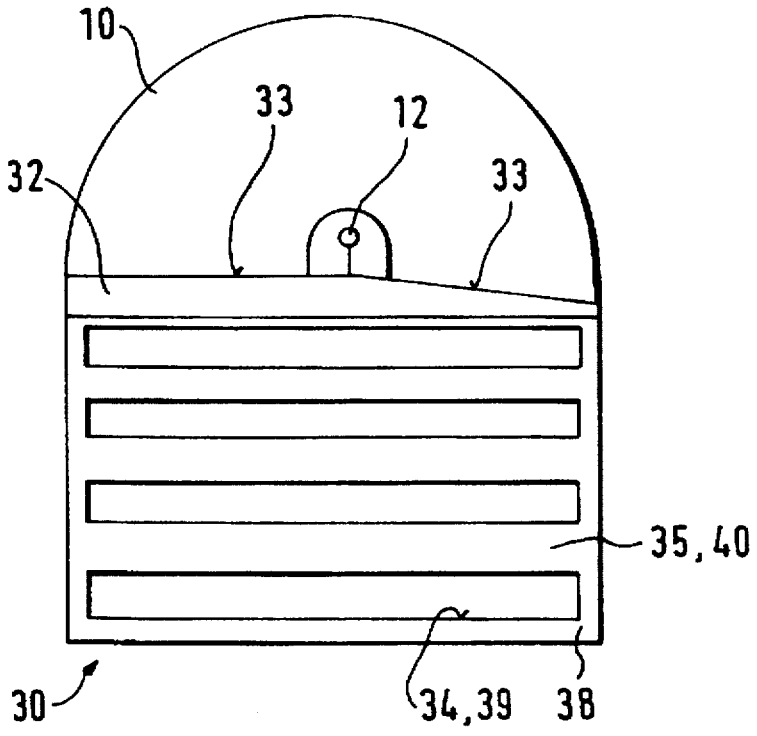
FIG. 2 is a view showing the inventive headlight in a section taken along the line 2—2 in FIG. 1.
Figure 3:
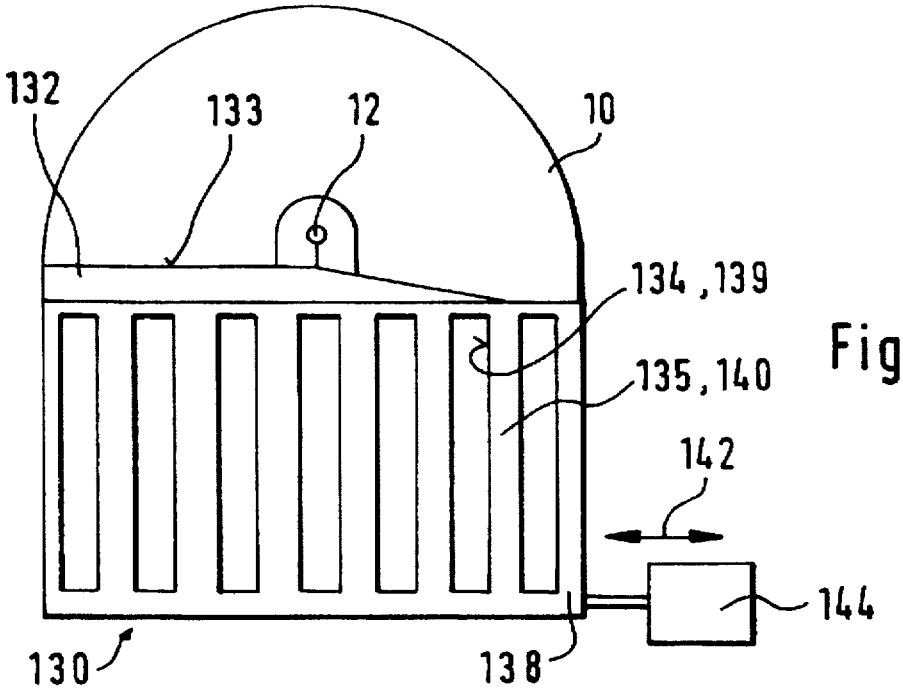
FIG. 3 is a view showing a cross-section of a headlight in accordance with a second embodiment of the present invention.

A headlight for a vehicle, in particular a motor vehicle shown in FIGS. 1–3 operates for selectively producing a low beam and a high beam. A headlight has a reflector 10 with a light source 12 arranged in its apex region. The light source 12 can be formed as an incandescent lamp or a gas discharge lamp. A reflector 10 has at least two different reflector regions which in the shown embodiment include an upper reflector region 14 and a lower reflector region 16. The transition between both reflector regions 14 and 16 can be located at the height of the optical axis 11 of the reflector 10 or below and above the same, so that the upper reflector region or the lower reflector region is greater. The transition between both reflector regions 14 and 16 can be continuous or can have a knee or a step. The upper reflector region 14 is formed so that the light emitted by the light source 12 is reflected from this region as a converging light beam. The upper reflector region 14 can have an ellipsoidal or ellipsoid-like shape or another suitable shape.

The headlight is provided with a lens 20 arranged after the reflector 10 in a light outlet direction 18. The light reflected by the upper reflector region 14 passes through the lens. The lens 20 is formed as a collecting lens and has for example a plane face 21 facing the reflector 10 and a convexly curved surface 22 facing away from the reflector 10. The convexly curved surface 22 of the lens 20 is preferably aspherical. The light reflected from the upper reflector region 14 is deviated by the lens 20, for example so that after passing through the lens 20 it is inclined in vertical longitudinal planes substantially parallel to the optical axis 11 or inclined in the light outlet direction 18 to it, and also dispersed in horizontal longitudinal planes. The lens 20 can be held in a support 24 which is mounted on the reflector 10. A light-permeable cover member 26 formed as a disk can be arranged after the lens 20 in the light outlet direction. It can be formed as a smooth disk or can be provided with optical elements for deviating the passing light. The reflector 20 can be arranged adjustably in a housing 28, and the cover member 26 can be mounted on the housing.

A screening device 30 is arranged between the reflector 10 and the lens 20. It extends substantially under the optical axis 11 and substantially perpendicular to it. The screening device 30 has a stationary screening part 32 provided with an upper edge 33 arranged substantially at the height of the optical axis 11 so as to form a bright-dark limit of the light beam passing on the edge. The edge 33, as shown in FIG. 2, can have different portions at the left side and at the right side of the optical axis 11, to produce an asymetrical bright-dark limit. The stationary screening part 32 is substantially flat and provided with several openings 34. In the embodiment shown in FIGS. 1 and 2, the openings 34 are formed as substantially horizontally extending slots arranged one over the other. The slots 34 are separated from one another by light-impermeable webs 35 having substantially the same width at the slots 34. The stationary screening part 32 can be held on the reflector 10 or on the support 24.

The screening device 30 also has a movable screening part 38 which can be arranged in the light outlet direction 18 closely before or after the stationary screening part 32 and also is substantially flat. The edge 33 for producing the bright-dark limit can be alternatively formed on the movable screening part 38. The movable screening part 38 has several openings 39, similarly to the stationary part 32. In the first embodiment the openings 39 are formed as substantially horizontally extending slots which are arranged one over the other. The slots 39 are separated from one another by light-impermeable webs 40. The width of the webs 40 can be preferably somewhat greater than the width of the slots 34 of the stationary screening part 32.

The movable screening part 38 is movable in a vertical direction in accordance with an arrow 42 in FIG. 1 by an adjusting element 44 between a position for low beam and a position for high beam. In FIG. 1 the movable screening part 38 is shown in its position for low beam, in which it is arranged so that its web 39 overlap the slots 34 of the stationary screening part 32. Because of the somewhat greater width of the web 35 relative to the slots 34, it is guaranteed that the slots 34 are completely covered by the webs 40. In this position of the movable screening part 38, the screening device 30 is thereby light-impermeable so that the light reflected from the lower reflector regions 16 cannot pass through it and cannot leave the headlight. The light reflected from the upper reflector region 14 can pass above the edge 33 of the stationary screening part 32 on the screening device 30 and forms a low beam having an upper bright-dark limit produced by the edge 33.

In FIG. 2 the movable screening part 38 is shown in its position for high beam. In this position it is displaced in a vertical direction so that its slots 39 at least approximately coincide with the slots 34 of the stationary screening part 32 and the screening device 30 therefore forms throughgoing openings. The light reflected by the lower reflector region 16 can pass through the slots 34, 39 and exit the headlight so that, together with the light reflected from the upper reflector region 14 and passing above the screening device 30, it forms a high beam. The lower reflector region 16 can be formed so that it reflects the light emitted by the light source 12 substantially parallel to the optical axis 11. The light reflected from the lower reflector region 16 after passage through the opening 34, 39 of the screening device 30 can pass through the lens 20 or pass along the same. The cover member 26 can be provided with optical elements for deviating the light reflected by the lower reflector region 16, preferably to be dispersed in a horizontal direction.

An adjusting element 44 can be arranged under or laterally near the screening device 30 and operate by an electric motor, pneumatically or hydraulically, and actuatable by a control device 46. The control device 46 can be connected with a switch 48 for switching between low beam and high beam by the vehicle driver. The adjusting element can be provided with an adjusting member which engages the movable screening part 38 and is movable rectilinearly in a vertical direction, or is formed an eccentric pivotally connected with the screening part 38. The required adjusting path of the movable screening part 38 between its positions for low beam and high beam is small, so that the adjusting element 44 can be compact and can provide a fast switching between low beam and high beam. For selectively producing low beam and high beam, the light source 12 can be provided with a light body, or in other words an incandescent coil for an incandescent lamp or a light arc for a gas discharge lamp.

FIG. 3 shows the headlight in accordance with the second embodiment in which the substantial structure of the headlight is not changed, but the screening device 130 is modified. The screening device 130 has a stationary screening part 132 with an edge 133 and a movable screening part 138, which have correspondingly several openings 134 and 139. The openings 134 and 139 are formed as substantially vertical extending slots which are separated from one another by light-impermeable webs 135 and 140. The width of the web 140 of the movable screening part 138 is substantially greater than the width of the slot 134 of the stationary screening part 132 for providing an overlap. The movable screening part 138 is movable by the adjusting element 144 horizontally in direction of the double arrow 142 between its position for low beam in which its web 140 covers the slot 134 of the stationary screening part 132, and its position for high beam in which its slot 139 is arranged substantially to coincide with the slot 134 of the stationary screening part 132. The adjusting element 144 can be formed as in the first embodiment and arranged under or laterally near the screening device 130.

A cover device 50 is provided in the housing 28 of the headlight. It at least partially surrounds the reflector 10 and covers the adjusting element 44 or 144, so that the latter is not visible from outside of headlight when looking through the cover member 26.

It will be understood that each of the elements described above, or two or more together, may also find a useful application in other types of constructions differing from the types described above.

While the invention has been illustrated and described as embodied in headlight for vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A headlight for vehicles, comprising a light source; a reflector having at least two different reflector regions including a first reflector region which reflects a light emitted by said light source as a converging light beam to form low beam and a second reflector region formed so that light emitted by said light source and reflected by said second reflector region together with the light emitted by said light source and reflected by said first reflector region form high beam; a lens arranged after said reflector in a light outlet direction so that at least the light which forms low beam passes through said lens; and a screening device arranged between said reflector and said lens, said screening device having a stationary screening part and a movable screening part, said movable screening part being movable between a position for low beam in which the light forming low beam can pass along said movable screening part and a position for high beam in which additionally the light reflected by said second reflector region can pass along said movable screening part at least partially, so that in the position for low beam an edge of said screening device forms a bright-dark limit of low beam, said screening parts each having a plurality of openings formed so that in the position of said movable screening part for low beam said movable screening part covers said openings of said stationary screening part, and in the position for high beam said openings of said movable screening part coincide with said openings of said stationary screening part at least approximately so that said screening device forms throughgoing openings for the light.

2. A headlight as defined in claim 1, wherein said openings are formed as substantially horizontally extending slots, said movable screening part being movable between said positions for low beam and for high beam in a substantially vertical direction.

3. A headlight as defined in claim 1, wherein said openings are formed as substantially vertically extending slots, said movable screening part being movable between said positions for low beam and high beam in a substantially horizontal position.

4. A headlight as defined in claim 1, wherein each of said screening parts has light-impermeable webs separating said openings from one another, said webs of said movable screening part having a substantially greater width than said openings of said stationary screening part.

5. A headlight as defined in claim 4, wherein said openings of said screening parts are formed as slots, said webs of said movable screening part having a substantially greater width than said slots of said stationary screening part.

* * * * *